US005673668A

United States Patent [19]

Pallett et al.

[11] Patent Number: 5,673,668

[45] Date of Patent: Oct. 7, 1997

[54] METHOD AND APPARATUS FOR ELECTRONIC THROTTLE MONITORING

[75] Inventors: Tobias J. Pallett, Ypsilanti; Kelly M. Arbanas, Northville; Paul J. Szuszman, Dearborn; Stephen J. Deasy, Troy; Dorian Gluckman, Birmingham, all of Mich.

[73] Assignee: Ford Global Technologies, Inc., Dearborn, Mich.

[21] Appl. No.: 691,966

[22] Filed: Aug. 5, 1996

[51] Int. Cl.[6] ..... F02M 7/10

[52] U.S. Cl. ..... 123/436; 123/479; 123/349

[58] Field of Search ..... 123/436, 479, 123/349, 489, 352, 399; 364/431.04, 431.03, 431.11

[56] References Cited

U.S. PATENT DOCUMENTS

| | | | |
|---|---|---|---|
| 3,834,361 | 9/1974 | Keely | 123/32 EA |
| 4,242,728 | 12/1980 | Hartford | 364/431 |
| 4,310,889 | 1/1982 | Imai et al. | 364/431.04 |
| 4,328,547 | 5/1982 | Barman et al. | 364/431.09 |
| 4,386,427 | 5/1983 | Hosaka | 371/11 |
| 4,437,342 | 3/1984 | Hosaka et al. | 73/119 A |
| 4,491,112 | 1/1985 | Kanegae et al. | 123/479 |
| 4,572,143 | 2/1986 | Umesaki et al. | 123/479 |
| 4,583,176 | 4/1986 | Yamato et al. | 364/431.11 |
| 4,603,675 | 8/1986 | Junginger et al. | 123/489 |
| 4,718,016 | 1/1988 | Sudo | 364/431.07 |
| 4,748,566 | 5/1988 | Sasaki et al. | 364/431.11 |
| 4,787,352 | 11/1988 | Anderson | 123/352 |
| 4,797,828 | 1/1989 | Suzuki et al. | 364/431.04 |
| 4,805,576 | 2/1989 | Abe et al. | 123/479 |
| 4,850,325 | 7/1989 | Abe et al. | 123/479 |
| 4,875,456 | 10/1989 | Tomisawa | 123/585 |
| 4,910,494 | 3/1990 | Tamai | 340/438 |
| 4,969,104 | 11/1990 | Suzuki et al. | 364/431.06 |
| 4,996,643 | 2/1991 | Sakamoto et al. | 364/424.03 |
| 5,019,799 | 5/1991 | Oshiage et al. | 340/438 |
| 5,047,944 | 9/1991 | Ishikawa et al. | 364/431.11 |
| 5,056,023 | 10/1991 | Abe | 364/424.03 |
| 5,056,484 | 10/1991 | Denz et al. | 123/399 |
| 5,204,816 | 4/1993 | Wright et al. | 364/431.11 |
| 5,233,530 | 8/1993 | Shimada et al. | 364/431.05 |
| 5,419,293 | 5/1995 | Nagai | 123/336 |
| 5,461,569 | 10/1995 | Hara et al. | 364/431.03 |
| 5,481,909 | 1/1996 | Deutsch et al. | 123/436 |
| 5,529,041 | 6/1996 | Andrews | 123/436 |
| 5,551,396 | 9/1996 | Suzuki et al. | 123/399 |
| 5,559,705 | 9/1996 | McClish et al. | 364/431.07 |
| 5,560,341 | 10/1996 | Machida | 123/479 |
| 5,576,963 | 11/1996 | Ribbens et al. | 364/431.08 |
| 5,581,022 | 12/1996 | Sprague et al. | 123/436 |

*Primary Examiner*—Raymond A. Nelli
*Attorney, Agent, or Firm*—Peter Abolins; Roger L. May

[57] ABSTRACT

A method and apparatus for executing a strategy of electronic throttle monitoring of a powertrain system including an electronic powertrain control module, and an electronic throttle control, includes an independent processor receiving signals shared with the powertrain control module from sensors and actuators on the vehicle. The monitor operates in a monitoring mode to detect faults occurring in the powertrain or the powertrain control module, and determines whether mitigating conditions occur in conjunction with detected power output greater than power demand. In the event that these mitigating conditions are not detected, the monitor operates in a limiting mode to actuate decreases in power output below the level of power demand.

27 Claims, 3 Drawing Sheets

Fig. 1
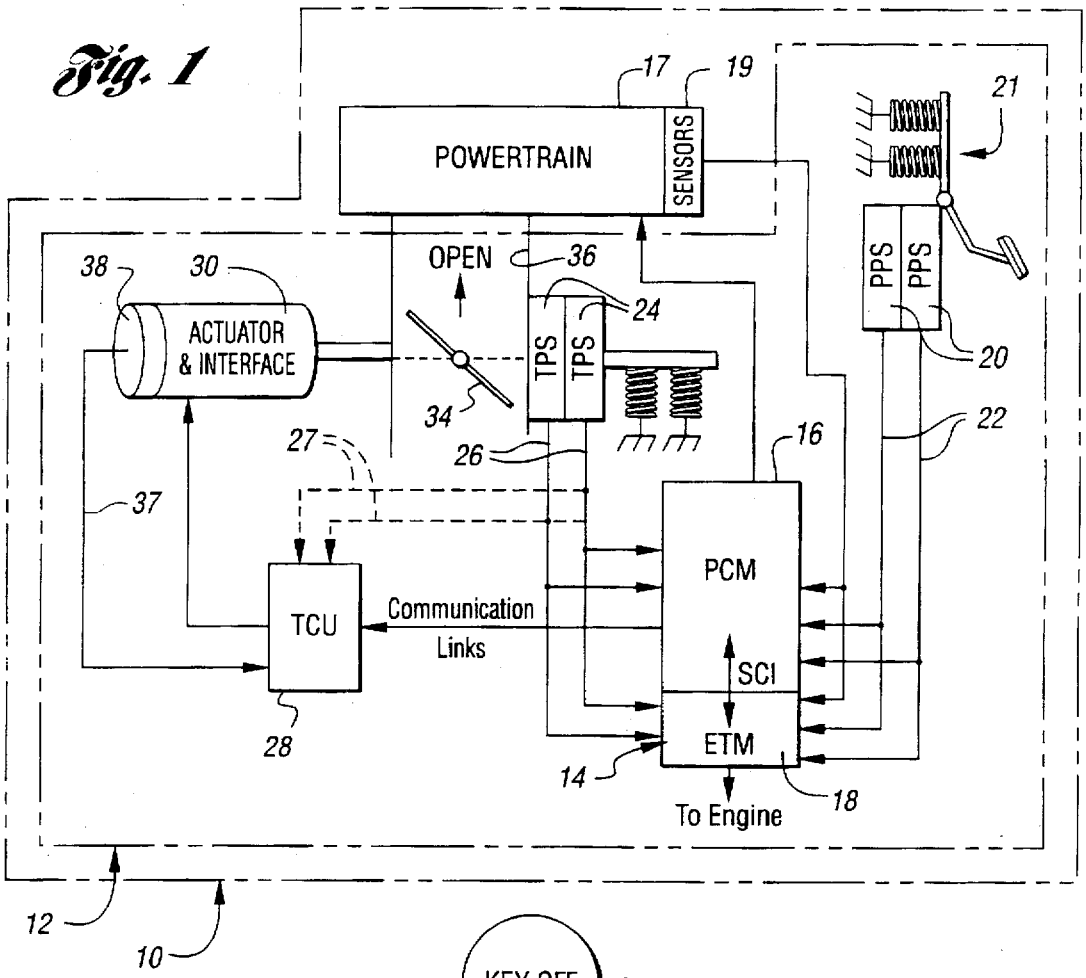
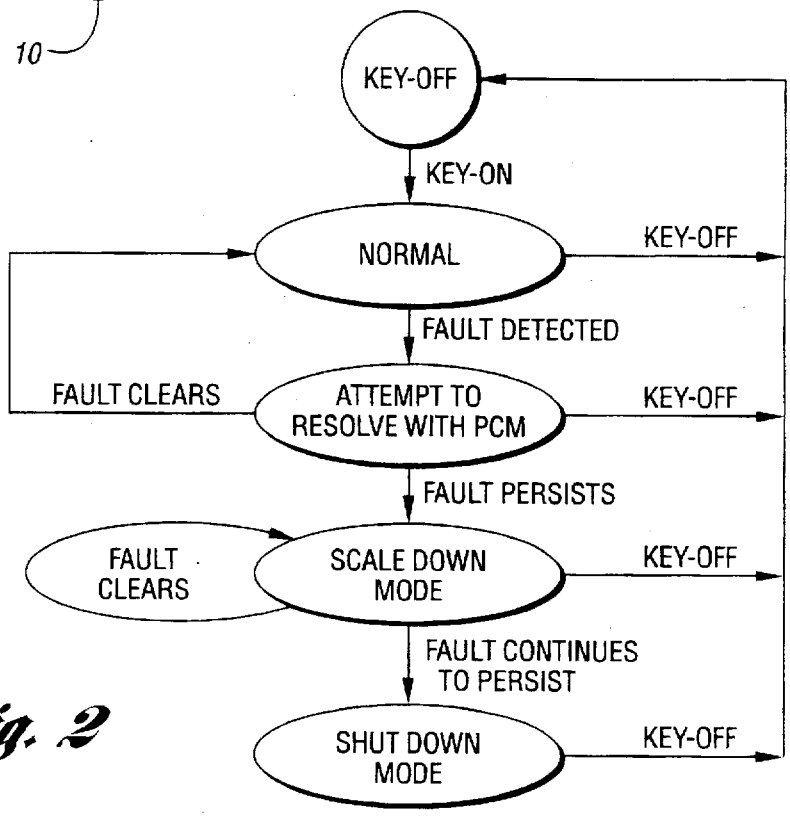
Fig. 2

METHOD AND APPARATUS FOR ELECTRONIC THROTTLE MONITORING

FIELD OF THE PRESENT INVENTION

The present invention relates to motor vehicle electronic throttle control with an electronic throttle monitor to detect and react to failure of portions of the powertrain control module (PCM) that affect the electronic throttle control system.

BACKGROUND

Many previously known motor vehicle throttle controls have a direct physical linkage between an accelerator pedal and the throttle body so that the throttle plate is pulled open by the accelerator cable as the driver depresses the pedal. The direct mechanical linkage includes biasing that defaults the linkage to a reduced operating position, in a manner consistent with regulations. Nevertheless, such mechanisms are often simple and unable to adapt fuel consumption efficiency to changing traveling conditions, and add significant weight and components to the motor vehicle.

An alternative control for improving throttle control and the efficient introduction of fuel air mixtures into the engine cylinders is presented by electronic throttle controls. The electronic throttle control includes a throttle control unit that positions the throttle plate by an actuator controlled by a microprocessor based on the current operating state determined by sensors. The processors are often includes as part of a powertrain electronic control that can adjust the fuel air intake and ignition in response to changing conditions of vehicle operation as well as operator control. Protection may be provided so that an electronic system does not misread or misdirect the control and so that unintended operation is avoided when portions of the electronic control suffer a failure.

One previously known type of protection to avoid unintended actuation of excessive throttle is to employ sensor redundancies, whereby more than one sensor responds to a particular condition so that the failure of a single sensor or an electronic component does not induce a throttle position greater than driver command.

Additionally, certain hardware backups of the PCM are available, for example, fixed fuel and spark commands along with a default throttle angle command sent via hardware when certain PCM failures are detected. This does not cover for all PCM failures, though. Use of multiple PCMs could resolve this. However, it raises the issue of how to select which PCM use. Additionally, the proliferation of parallel or redundant components can be expensive and does not address multiple failures or failures in components that have not been replaced by an act of an alternative component.

SUMMARY OF THE PRESENT INVENTION

The present invention overcomes the above-mentioned disadvantages by providing an electronic throttle monitor for a motor vehicle powertrain control system with a powertrain control module (PCM) having a processor and with an electronic throttle control. The electronic throttle monitor comprises an independent processor that performs a first set of functions in a normal operating mode including reading a set of powertrain sensors and commanders shared with a powertrain control module to determine if detected power is greater than demanded power. The monitor performs a second restricting function limiting output power to less than demanded power when detected power greater than demanded power has been detected. The monitor can be employed in combination with the powertrain control module by linkage with an appropriate interface.

In the preferred embodiment, the Electronic Throttle Monitor (ETM) is an independent means of monitoring the powertrain and its powertrain control module (PCM) or the electronic throttle control system, to ensure that neither a control module fault nor a system fault can result in an excessive engine operation. Preferably, the ETM is limited to monitoring the state of the Electronic Throttle Control (ETC) system, and limits the power delivered by the powertrain in the event of a fault that results in a power greater than demanded condition. In the normal operating mode, the electronic throttle monitor reads a set of powertrain sensors and communication interfaces from signals shared with the powertrain control module. Upon detection of a power output greater than demanded, the electronic throttle monitor operates in a restricting mode to reduce detected power to less than demanded power while continuing to monitor the system.

Preferably, the electronic throttle monitor receives inputs from chassis sensors and from driver control sensors and communicates indicia to the driver. Likewise, the electronic throttle monitor checks outputs from the powertrain system and provides corrective inputs to the powertrain control module. In addition, the monitor provides control signals to the powertrain control module as well as receiving sensor signals from the powertrain system components. Moreover, external diagnostic data interfaces can request diagnostic data from the electronic throttle monitor and a monitor can provide diagnostic data responses to those requests.

Accordingly, the present invention provides a method and apparatus for an electronic throttle control system that will not be subject to single fault system failures and the associated effects, such as defeating a redundancy of sensors, due to a single fault resulting in detected power greater than power demanded. The electronic throttle monitor operates independently of but with the same inputs as are shared by the powertrain control module to accommodate proper functioning of the powertrain in response to driver commands and proper functioning of the powertrain control module.

BRIEF DESCRIPTION OF THE DRAWING

The present invention will be more clearly understood by reference to the following detailed description of a preferred embodiment when read in conjunction with the accompanying drawing in which like reference characters refer to like parts throughout the views and in which:

FIG. 1 is a diagrammatic view of portions of a powertrain system including electronic controls and an electronic throttle monitor for motor vehicles according to the present invention;

FIG. 2 is a block diagram of general monitoring tasks performed by the monitor shown in FIG. 1;

DETAILED DESCRIPTION OF THE PREFERRED EMBODIMENT

Figure 3:
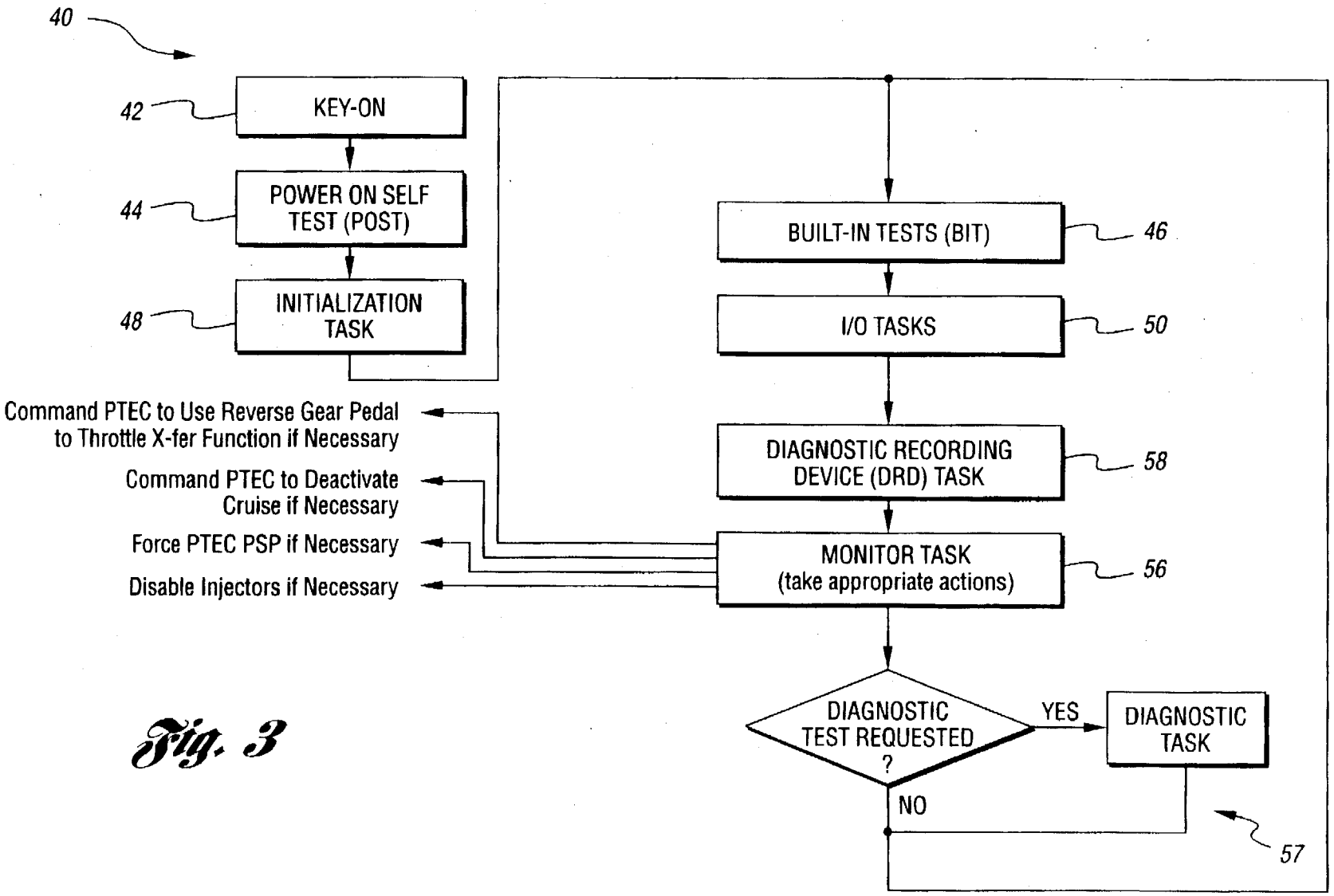
FIG. 3 is a block diagram of a preferred main program of an electronic throttle monitor shown in FIG. 1.

Referring first to FIG. 1, a motor vehicle powertrain system 10 including electronic throttle control system 12 includes an electronic control unit 14. In the preferred embodiment, the electronic control unit 14 includes a powertrain control module (PCM) 16 including a main processor and an electronic throttle monitor (ETM) 18 including an independent processor. The PCM and ETM share sensors 19 and actuators that are associated with the powertrain system 17 and control module 16. Preferably, the electronic throttle monitor 18 includes a processor physically located within the powertrain control module housing, although a separate housing, separate locations and other embodiments can also be employed in practicing the invention. Moreover, while the electronic throttle monitor 18 and the powertrain control module 16 have independent processors, they share the inputs and outputs of powertrain sensors 19 and actuators 21 and 34, respectively, for the independent processing.

A wide variety of inputs are represented in the FIG. 1 diagram by the diagrammatic representation of redundant pedal position sensors 20. The sensors 20 are coupled through inputs 22 and are representative of many different driver controls that may demonstrate the demand for power. In addition, the electronic control unit 14 includes inputs 26 for detecting output power representations. A variety of ways for providing such indications is simply, diagrammatically represented in FIG. 1 by the redundant throttle position sensors 24 to obtain a power output indication. As a result of the many inputs represented at 19, 22 and 26, the electronic controller 14 provides outputs for limiting output power so that output power does not exceed power demand. A variety of outputs are also diagrammatically represented in FIG. 1 by the illustrated example of inputs to a throttle control unit 28 that in turn powers an actuator and motive interface 30 for displacing the throttle plate 34. For example, an actuator and interface may comprise redundant drive motors powering a gear interface to change the angle of the throttle plate 34 in the throttle body 36.

Likewise, the responsive equipment like motors may also provide feedback, for example, the motor position sensor 38 or the throttle position sensors 24 may provide feedback to the throttle control unit 28, as shown at 37 and 27, respectively, to determine whether alternative responses are required or to maintain information for service or repair.

In any event, the throttle plate adjustment equipment 30 shown in FIG. 1 is only an example of equipment for limiting power output. The limiting operation may include responsive equipment such as spark timing set to a predetermined spark advance, preferably a setting that corresponds to an idle condition, or systems delivering fuel to the cylinders, for example, a fuel setting corresponding to an idle condition, may also be employed to provide the proper response of decreasing power output when a power output level detected exceeds the power demand level. Additional inputs and responses will be discussed below.

Moreover, powertrain electronic controls have been designed with powertrain system protection (PSP) functions which provide for a scale-down mode of the operation in the event of a failure. For example, the angle of the throttle plate within the throttle body may be limited to restrict airflow through the throttle body when an electronic failure is detected. In addition, ignition timing can be set to a predetermined level that reduces power produced by the powertrain upon detection of an electronic fault. In addition, fuel delivery can be restricted to reduce the amount of power produced by the powertrain. However, a failure of any of these systems, particularly electronic failures, can adversely affect the system's ability to counteract a condition that induces power output exceeding power demand. Moreover, detection of a fault may reduce power output even where response to a system failure is not required to reduce output below demand.

Operative controls 21 for setting demand are illustrated as a pedal activated by a driver's foot, but may include other manipulators. For example, while an accelerator pedal is used to demand power from the powertrain, the brake and clutch pedals can be used to temporarily disengage vehicle speed control through associated switches. In addition, a brake on/off switch, a brake pedal switch, a clutch engaged switch for a manual transmission and redundant pedal position sensors may be input to the electronic control unit 14. Likewise, hand controls used to specify gear selection or to select a cruise mode of operation for maintaining vehicle speed are included as inputs. For example, an on/off switch for a cruise control and its RESUME and CANCEL, Set/Accel and Set/Coast switches, a neutral switch and reverse switch for manual transmissions, and transmission range switches for automatic transmissions can provide digital or analog inputs to the electronic control unit 14. Likewise, the driver may receive indicia such as an illuminating representative indicator, for example an indicator light on the dashboard, indicating when an electronic throttle monitor 18 has entered a restricted mode of operation.

The powertrain control module 16 has a central processing unit that communicates with an independent processor in the electronic throttle monitor 18. Signals between the powertrain control module 16 and the electronic throttle monitor 18 are handled via a serial peripheral interface (SPI) for communication, including, for example, coded signals for ETM faults, a flag indicating that the cruise control is enabled, a Diagnostic Recording Device Contains Data flag, and a Neutral/in gear status signal, the information being passed on a periodic basis. If the communication link is lost, each of the powertrain electronic control module 16. and the electronic throttle monitor 18 sets the parameters to default values, a restrictive state. For example, a default setting may be to switch from a drive pedal follower transfer function to a less responsive setting, for example, the Reverse transfer function, that has a reduced response level to pedal depression. Other outputs passed from the powertrain control module 16 over the communications interface (SPI) include cruise mode status, Reverse/forward status, Neutral/in gear status, calibration identification, vehicle speed such as from an ABS module, and other throttle control functions.

The electronic throttle monitor 18 interfaces with the powertrain 10 by signals that put the vehicle in a restricted mode of operation to decrease the power to the powertrain when certain subsystems fail. For example, a Powertrain Systems Protect (PSP) enabling signal can actuate protection normally commanded by the powertrain control module 16. For example, the ETM can disable the main PCM and thus force a fixed fuel and spark control via hardware that corresponds to an idle condition. Similarly, an injector disable signal can disable fuel injectors to discontinue combustion altogether. The ETM may also provide a redundant throttle position signal to the throttle control unit 28. Sensor signals received from the powertrain include cylinder head temperature, engine speed, vehicle speed, numbers of injectors on, and throttle position 24.

The electronic throttle monitor 18 will have an interface that can be connected to external equipment such as diagnostic equipment as shown at 57 in FIG. 3. The external equipment can access information in the monitor 18 to diagnose vehicle system failures throughout the life of the vehicle. The external equipment will provide parameters that control the state of the diagnostic interface while the monitor 18 responds to the request for selected parameters with specific data. The electronic throttle monitor 18 also includes a diagnostic recording device 58 which is a data logging device that continuously logs data to provide a flight recorder-like function. Storage of this data is triggered by communication with the chassis, for example, an inertia switch's digital signal. An interface to an engineering diagnostic or data recording device on a time available basis provides information management without interfering with powertrain system operation, and it avoids interfering with powertrain operation when the interface is being serviced or is totally disconnected.

The overall operating format for the electronic throttle monitor 18 shown in FIG. 2 demonstrates a normal operation, the state in which the ETM 18 monitors the vehicle operation when the ignition has been actuated. When the monitoring detects a fault, three restricting modes of operation are also illustrated in FIG. 2. The ETM does not interfere with engine operation so long as powertrain control module 16 maintains power output below power demand. Nevertheless, when the powertrain control module is unable to maintain that condition, the ETM 18 introduces restricted mode commands to the electronic throttle control system 12 and scales down the operation of the engine. This may be accomplished by reducing fuel delivery, using a sequential injector cut-off mechanism, or induce reliance upon a different transfer function for response to the driver demand, or other features discussed in greater detail below. If the restricting mode fails to decrease power output below power demand levels, the restricted operation becomes shut-down mode, for example, cutting off fuel delivery to the injectors.

Referring now to FIG. 3, the main program 40 of the electronic throttle monitor 18 is shown to be initiated by ignition key actuation at 42. The first loop through the software program 40 must be completed within a predetermined time from key through the first loop before the fuel injectors will be enabled by an appropriate signal. Therefore, the first loop must be completed quickly enough to not adversely affect starting the engine. After power-up initialization processes 44 and 48, and the first time through the loop are completed, the main processing loop will run at a predetermined fixed rate. If a monitor 18 failure is detected by the Power On Self-Test 44 or the Built-In Test 46, the monitor of the preferred embodiment will determine that power restrictions are imposed or disable all injectors, depending on the fault detected. Additionally, the ETM 18 may send a periodic signal to a special hardware circuit that if not properly "pulsed" will shut the engine off. This is to protect against loss of the monitor. If the monitor 18 recovers from the failure, the system will be allowed to recover to its normal state after an ignition reset, by re-actuation performed by the driver, has occurred. Other modes of clearing other restricted modes, for example reenabling a disabled cruise control or a disabled Forward pedal follower transfer function, may require other controller manipulations by the driver for reenabling these functions.

The Power On Self-Test 44 includes a number of tests including stack, RAM, ROM/EPROM, A/D convertor, and timer. Upon power-up, the portion of RAM allocated to system stack is tested prior to calling any functions or enabling any interrupts. In the RAM test, the system RAM will be tested to detect address and data bits that are stuck or shorted to other bits. In the ROM test, a check sum shall be performed to verify that ROM/EPROM's can be successfully programmed. In addition, A–D conversions are done in the convertor test and proper operation of the counter/timer circuits is determined. After the Power On Self-Test 44, the initialization task 48 initializes hardware and the registers.

During I/O Tasks 50, the powertrain sensor input signals are read, filtered and checked for failures in every software loop. As a result, a series of status signals are received and/or calculated in this task preferably including brake status, cruise switch input, cruise control On, diagnostic enabling, engine coolant temperature, engine speed and engine acceleration, pedal position sensor signals, foot-on-pedal flags, injector status, throttle position sensor processing, transmission mode, idle engine RPM limit and PCM to ETM communications, vehicle speed and acceleration, driver demand and dashpot demand. Input processing of driver demand preferably follows one of two transfer functions that the pedal follower system uses for determining a response to the driver's requested throttle position. A Forward transfer function is used for most conditions including driver requested Neutral or Drive while a less aggressive Reverse transfer function is used only when the driver has requested Reverse or when a protection command is generated from the powertrain control module 16 or the electronic throttle monitor 18.

Figure 4:
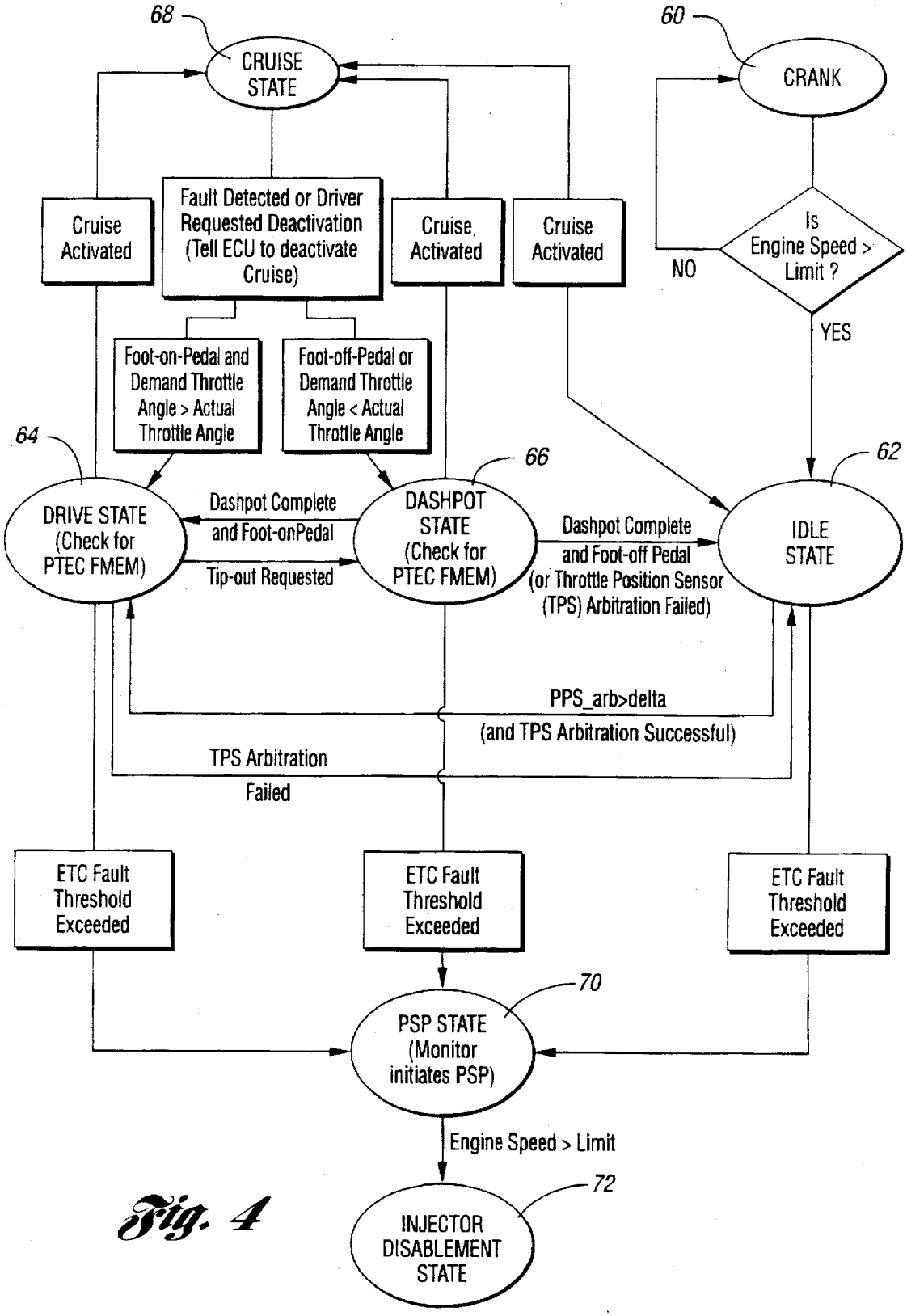
FIG. 4 is a state diagram of interactive operating states in the powertrain system including the electronic throttle monitor of FIGS. 1 and 2.

For the monitoring task, the monitor 18 observes the powertrain system and transitions between the monitor states based on current operating conditions of the vehicle and determinations that the powertrain system is functioning properly based on each monitor state. As best shown in FIG. 4, the monitor states are crank 60, idle 62, drive 64, dashpot 66, cruise 68, PSP 70 and injector disablement 72. The monitor always begins in the crank state 60, from which transitions are made into the other states as shown in FIG. 4. If the monitor detects actual operating parameters representative of output power greater than demanded power, the monitor 18 will initiate an appropriate restricted mode of operation, for example, disengaging cruise control, forcing operation according to the Reverse pedal follower transfer function, initiating PSP (for example, fixed fuel or fixed spark hardware control) in the powertrain control module 16 or disabling the injectors.

The current state of the monitor task 56 is tracked. At power-up, the state is initialized to Crank state and the system then transitions to the other states. In the Crank state, the monitor 18 monitors engine rpm to determine when to exit to Idle state. The monitor 18 double-checks the redundant engine RPM sensors during Crank state 60 by looking at injector activity to determine if the engine is running in order to protect against a loss of engine speed signal.

In the Cruise State 68, the monitor 18 looks for requests for cruise deactivation such as the brake Off switch, Cancel switch actuation that enables the set speed to be retained, or a speed limiter control which does not permit engagement of cruise at high vehicle speeds. In addition, the monitor 18 determines if vehicle acceleration exceeds maximum allowable closed loop speed control acceleration levels. If cruise deactivation commands or unacceptable levels of acceleration are detected, then the monitor 18 disables cruise control via request to the powertrain control module 16.

In the drive state 64, the monitor 18 detects actual throttle angle and compares it to driver requested throttle angle. If the actual throttle angle is greater than the driver requested throttle angle, the monitor 18 will check to see if the electronic control unit 14 is mitigating the failure by shutting off injectors. If the failure persists and is not mitigated by the powertrain control module 16, the monitor 18 will transition to PSP state 70.

At idle state 62, the monitor 18 detects engine speed and compares it to the maximum engine speed limit. If actual engine speed is greater than the limit as calculated in the I/O Tasks 50 based on normal idle speed, the monitor 18 checks to see if the vehicle is coasting downhill (i.e., not producing positive torque as indicated by low throttle angle). If the failure persists and the vehicle is not coasting downhill, the monitor 18 will transition to PSP state 70.

In dashpot state 66, the monitor 18 detects actual throttle angle and compares it to the dashpot requested throttle angle. If actual throttle angle is greater than the dashpot requested throttle angle, the monitor 18 checks for the mitigation of output greater than demand by the powertrain control module 16. If the failure persists and is not mitigated by the powertrain control module 16, the monitor 18 can transition to PSP state 70.

The PSP state 70 is entered after a power output greater than power demand fault has been detected. The monitor 18 monitors engine speed and compares it to maximum engine speed limit allowed/expected during hardware control of fuel and spark. When the speed is greater than the limit, the monitor will disable all injectors and exit to the Injector Disablement state 72. When the monitor 18 stays in PSP state 70, the monitor 18 will not transition back to any of the normal operating states until a key Off/key back On re-initialization occurs.

In any event, the monitor task 56 provides the opportunity for selecting outputs depending upon the input condition detected. For example, the monitor 18 may provide signals to command the powertrain control module 16 to use the Reverse pedal-to-throttle transfer function or to deactivate the cruise control, if necessary and thus mitigate/prevent discrepancies between the two processors. In addition, the ETM can force a protective function such as disabling PCM control of fuel, spark and throttle, thus forcing the system into idle condition. Furthermore, the monitor can provide a direct output to the injection drivers to completely disable the injectors if necessary.

As a result, the electronic throttle monitor 18 of the present invention assures proper operation of a powertrain control module 16 and the powertrain system 10 of a motor vehicle while monitoring sampled functions. In addition, the monitor 18 shares inputs previously employed in a powertrain control to independently verify that the powertrain control module 16 and the powertrain system 10 is operating in a manner to avoid a power output greater than power demand condition. As a result, the present invention provides a method and apparatus having an additional layer of protection to previously known redundancy layers and powertrain system protection layers previously developed.

Having thus described the present invention, many modifications will become apparent to those skilled in the art to which it pertains without departing from the scope and spirit of the present invention as defined in the appended claims.

What is claimed is:

1. An electronic throttle monitor for a motor vehicle powertrain system with an electronic throttle control and a powertrain control module (PCM) including a main processor comprising:

a processor independent of the main processor, said independent processor ordered to perform a monitoring function in a first operating mode including reading a set of powertrain sensors and communication interfaces shared with the PCM and determining when detected power is greater than demanded power;

said processor being programmed to perform a limiting function in a second operating mode for limiting detected power to less than demanded power when detected power is greater than demanded power.

2. The invention as defined in claim 1 wherein said powertrain control module includes powertrain control module limiter commands and said second operating mode comprises enabling said powertrain control module limiter commands.

3. The invention as defined in claim 2 wherein said monitor transfers state information to said powertrain control module.

4. The invention as defined in claim 1 wherein said motor vehicle powertrain system includes fuel injectors and wherein said second operating mode comprises disabling said fuel injectors.

5. The invention as defined in claim 1 wherein said powertrain system includes a cruise control and wherein said second operating mode comprises disengaging said cruise control.

6. The invention as defined in claim 1 wherein said powertrain control module includes a pedal follower transfer function and wherein said second operating mode comprises modifying the pedal follower transfer function.

7. The invention as defined in claim 6 wherein said powertrain control module includes a Forward pedal follower transfer function and a Reverse pedal follower transfer function of reduced slope, and wherein said second operating mode comprises disabling said Forward pedal follower transfer function.

8. An electronic throttle control for a motor vehicle powertrain comprising:

a powertrain control module, sensors, actuators, and an electronic throttle control;

an interface including inputs from said sensors shared with the powertrain control module;

an electronic throttle monitor including an independent processor including a first operating mode determining whether engine power exceeds power demand and a second operating mode enabling one of a plurality of decreasing power output signals.

9. The invention as defined in claim 8 wherein said first monitoring mode comprises monitoring driver input state.

10. The invention as defined in claim 8 wherein said first monitoring mode comprises monitoring dashpot state.

11. The invention as defined in claim 10 wherein said monitoring dashpot state comprises comparing actual throttle plate position to expected throttle plate position.

12. The invention as defined in claim 8 wherein said first monitoring mode comprises monitoring engine idling state.

13. The invention as defined in claim 12 wherein said monitoring engine idling state comprises comparing engine speed to desired speed.

14. The invention as defined in claim 8 wherein said first monitoring mode comprises monitoring cruise control state.

15. The invention as defined in claim 14 wherein said monitoring cruise control state comprises comparing vehicle acceleration to a cruise control acceleration limit and by monitoring driver requested canceling of cruise control.

16. The invention as defined in claim 8 wherein said first monitoring mode comprises monitoring drive state.

17. The invention as defined in claim 16 wherein said monitoring drive state comprises comparing desired throttle plate position to actual throttle plate position.

18. The invention as defined in claim 8 wherein said first monitoring mode comprises monitoring crank state.

19. The invention as defined in claim 18 wherein said monitoring crank state comprises comparing engine speed to engine speed crank threshold.

20. A method for monitoring a motor vehicle powertrain having a powertrain control module with a processor for controlling actuators and responding to sensors for engine throttle control comprising:

monitoring by independently processing inputs shared with the powertrain control module for detecting a power level greater than power demand, and decreasing the power level when detected power level is greater than power demand and a fault in said powertrain control module fails to control said actuators.

21. The invention as defined in claim 20 wherein said powertrain control module includes hardware control of spark, fuel and throttle and wherein said decreasing step comprises actuating said hardware.

22. The invention as defined in claim 21 wherein said decreasing power level step comprises forcing limitation control by said powertrain control module.

23. The invention as defined in claim 22 wherein said decreasing commanded power level step comprises commanding a restricted level of engine operation.

24. The invention as defined in claim 22 wherein said decreasing commanded power level step comprises disabling engine operation.

25. The invention as defined in claim 24 wherein said disabling step comprises shutting off fuel.

26. The invention as defined in claim 20 and further comprising storing data in a diagnostic recording device.

27. The invention as defined in claim 20 and further comprising diagnosing the system via external hardware independent of said monitoring.

* * * * *